US010676804B2

(12) United States Patent
Allely et al.

(10) Patent No.: US 10,676,804 B2
(45) **Date of Patent: *Jun. 9, 2020**

(54) STEEL SHEET PROVIDED WITH A COATING PROVIDING SACRIFICIAL CATHODIC PROTECTION COMPRISING LANTHANE

(71) Applicant: ArcelorMittal, Luxembourg (LU)

(72) Inventors: Christian Allely, Maizieres-les-Metz (FR); Jacques Petitjean, Thionville (FR)

(73) Assignee: ARCELORMITTAL, Luxembourg (LU)

( * ) Notice: Subject to any disclaimer, the term of this patent is extended or adjusted under 35 U.S.C. 154(b) by 240 days.

This patent is subject to a terminal disclaimer.

(21) Appl. No.: 15/314,457

(22) PCT Filed: May 28, 2015

(86) PCT No.: PCT/EP2015/061891

§ 371 (c)(1),
(2) Date: Nov. 28, 2016

(87) PCT Pub. No.: WO2015/181318

PCT Pub. Date: Dec. 3, 2015

(65) Prior Publication Data

US 2017/0198374 A1 Jul. 13, 2017

(30) Foreign Application Priority Data

May 28, 2014 (WO) ..... PCT/IB2014/061788

(51) Int. Cl.
*C21D 9/46* (2006.01)
*C22C 21/10* (2006.01)
(Continued)

(52) U.S. Cl.
CPC ..... *C22C 21/10* (2013.01); *C21D 9/46* (2013.01); *C23C 2/12* (2013.01); *C23C 2/26* (2013.01); *C23C 2/28* (2013.01)

(58) Field of Classification Search
None
See application file for complete search history.

(56) References Cited

U.S. PATENT DOCUMENTS 8,663,818 B2 3/2014 Nose et al.
10,131,981 B2 * 11/2018 Fujita ..... C23C 2/40
(Continued)

FOREIGN PATENT DOCUMENTS

CN 101405421 A 4/2009
CN 101457320 A 6/2009
(Continued)

OTHER PUBLICATIONS

Machine-English translation of JP 2009-120948, Nose Koichi et al. Jun. 4, 2009.*
(Continued)

*Primary Examiner* — Colin W. Slifka
(74) *Attorney, Agent, or Firm* — Davidson, Davidson & Kappel, LLC

(57) ABSTRACT

A steel sheet is provided with a coating providing sacrificial cathodic protection. The coating includes between 1 and 40% by weight zinc, between 0.01 and 0.4% by weight lanthanum, optionally up to 10% by weight magnesium, optionally up to 15% by weight silicon, and optionally up to 0.3% by weight, in cumulative amounts, of additional components, the remainder includes aluminum and unavoidable impurities or residual elements. A method of producing parts by hot or cold swaging and the parts which can be obtained in this way are also provided.

16 Claims, 1 Drawing Sheet

(51) Int. Cl.

| | |
|---|---|
| ***C23C 2/12*** | (2006.01) |
| ***C23C 2/28*** | (2006.01) |
| ***C23C 2/26*** | (2006.01) |

(56) References Cited

U.S. PATENT DOCUMENTS

| | | | | |
|---|---|---|---|---|
| 2010/0276293 | A1 | 11/2010 | Priewasser et al. | |
| 2015/0284861 | A1* | 10/2015 | Allely | C21D 8/0278 204/196.1 |

FOREIGN PATENT DOCUMENTS

| | | | | | |
|---|---|---|---|---|---|
| CN | 101736217 | A | | 6/2010 | |
| CN | 101880800 | A | | 11/2010 | |
| CN | 103045980 | A | | 4/2013 | |
| EP | 1997927 | A1 | | 12/2008 | |
| JP | 2009120942 | A | | 6/2009 | |
| JP | 2011032498 | A | | 2/2011 | |
| WO | 2008135292 | A1 | | 11/2008 | |
| WO | 2013156688 | A1 | | 10/2013 | |
| WO | WO 2013/156688 | | * | 10/2013 | C23F 13/14 |
| WO | WO 2014/021452 | | * | 2/2014 | C23C 2/02 |

OTHER PUBLICATIONS

Yang et al., "Effects of lanthanum addition on corrosion resistance of hot-dipped galvalume coating", Journal of Rare Earths, Feb. 2009, p. 114-118, vol. 27, No. 1.

* cited by examiner

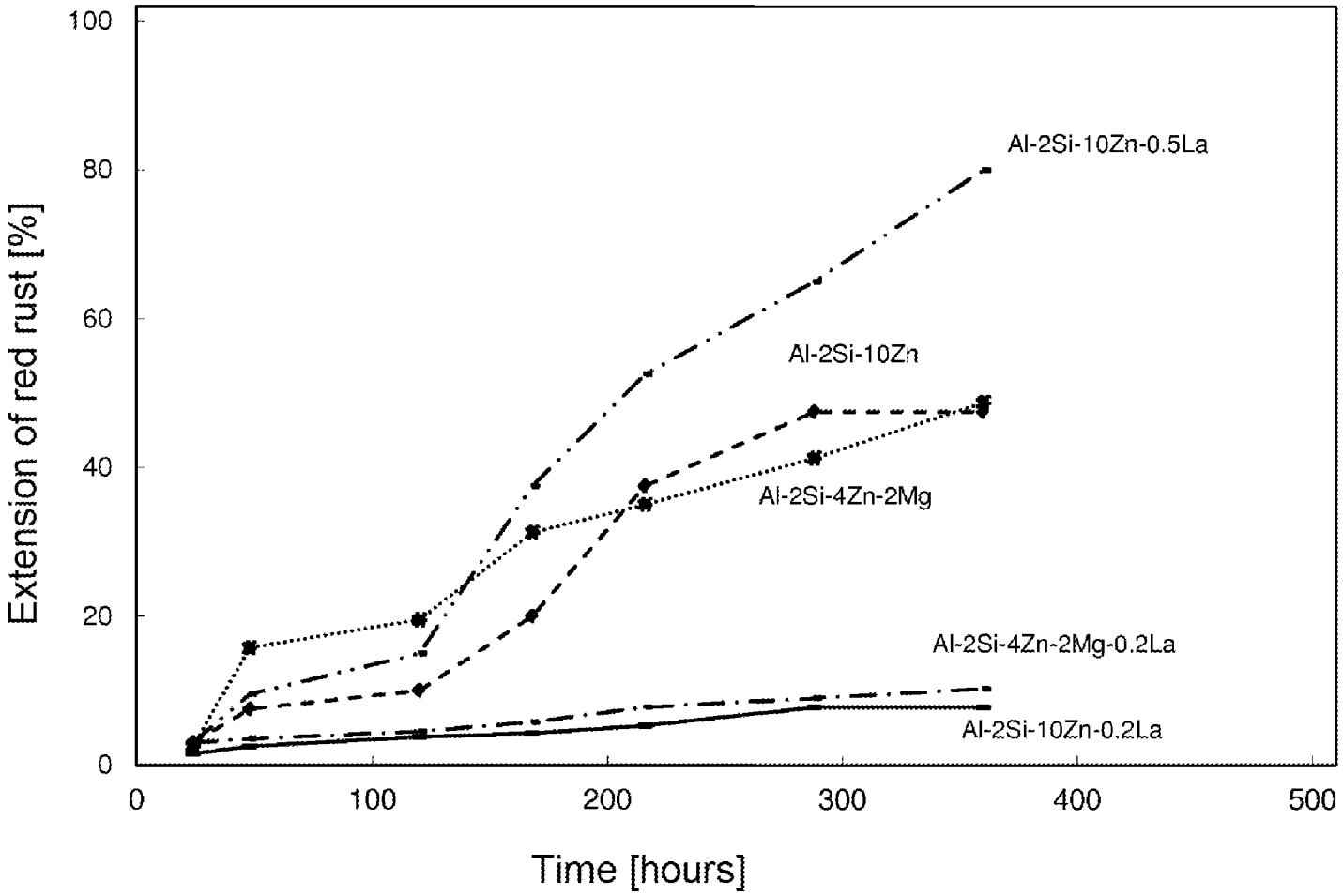
Al-2Si-10Zn-0.5La
Al-2Si-10Zn
Al-2Si-4Zn-2Mg
Al-2Si-4Zn-2Mg-0.2La
Al-2Si-10Zn-0.2La
Extension of red rust [%]
Time [hours]
0
20
40
60
80
100
0
100
200
300
400
500

STEEL SHEET PROVIDED WITH A COATING PROVIDING SACRIFICIAL CATHODIC PROTECTION COMPRISING LANTHANE

The present invention relates to steel sheet provided with a coating providing sacrificial cathodic protection, more particularly intended for the manufacture of automobile parts but not limited thereto.

BACKGROUND

At the present time, solely zinc or zinc alloy coatings provide reinforced protection against corrosion via twofold protection of barrier and of cathodic type. The barrier effect is obtained by applying the coating to the steel surface which prevents any contact between the steel and the corrosive medium and is independent of the type of coating and substrate. On the contrary, sacrificial cathodic protection is based on the fact that zinc is a less noble metal than steel and that, under corrosion conditions, it is consumed in preference to steel. This cathodic protection is essential in particular in areas where the steel is directly exposed to a corrosive atmosphere such as cut edges or damaged areas where the steel is exposed and the surrounding zinc will be consumed before any attack of the non-coated area.

However, because of its low melting point zinc gives rise to problems when parts need to be welded, since there is a risk that it may vaporize. To overcome this problem, one possibility is to reduce the thickness of the coating but in this case the lifetime of corrosion protection is limited. In addition, if it is desired to press harden a sheet, in particular by hot drawing, micro-cracks are seen to form in the steel which propagate from the coating. Also, the painting of some parts previously coated with zinc and press hardened require a sanding operation before phosphatation because of the presence of a fragile oxide layer on the surface of the part.

The other family of metal coatings frequently used to protect automobile parts is the family of coatings based on aluminum and silicon. These coatings do not generate any microcracking in steel during the forming process because of the presence of an intermetallic Al—Si—Fe layer, and they lend themselves well to paint application. While they allow protection to be obtained via a barrier effect and can be welded, they do not however allow any cathodic protection to be obtained.

Application EP 1 997 927 describes corrosion-resistant steel sheet coated with a coating comprising more than 35% by weight of Zn and comprising a phase in non-equilibrium having a heat capacity measured by differential scanning calorimetry of 1 J/g or higher, typically having an amorphous structure. Preferably, the coating comprises at least 40% by weight of zinc, 1 to 60% by weight of magnesium and 0.07 to 59% by weight of aluminum. The coating may comprise 0.1 to 10% lanthanum to improve the ductility and workability of the coating.

It is one of the objectives of the present application to overcome the disadvantages of prior art coatings by providing coated steel sheets having reinforced protection against corrosion, in particular before and after production by drawing. If the sheets are intended to be press hardened, in particular hot drawn, resistance against the propagation of microcracking in the steel is also sought and preferably with an operating window that is as wide as possible regarding time and temperature during heat treatment prior to press hardening.

In terms of sacrificial cathodic protection, it is sought to reach an electrochemical potential at least 50 mV more negative than that of the steel i.e. a minimum value of −0.78V relative to a saturated calomel electrode (SCE). However, it is not desired to go below a value of −1.4V, even −1.25V as this would cause too rapid consumption of the coating and reduce the lifetime of steel protection.

BRIEF SUMMARY

For this purpose, the subject of the invention is a steel sheet provided with protective sacrificial cathodic coating, the coating comprising from 1 to 40% by weight of zinc, 0.01 to 0.4% by weight of lanthanum, and optionally up to 10% by weight of magnesium, optionally up to 15% by weight of silicon and optionally up to 0.3% by weight in accumulated weight of possible additional elements, the remainder being aluminum and residual elements or unavoidable impurities.

The coating of the sheet of the invention may also incorporate the following characteristics taken alone or in combination:

- the coating comprises between 1 and 40% by weight of zinc, in particular from 1 to 34 weight % zinc, typically from 1 to 30 weight % zinc, preferably from 2 to 20 weight % zinc;
- the coating comprises from 0.05 to 0.4% by weight of lanthanum, typically 0.1 to 0.4 weight % lanthanum, preferably 0.1 to 0.3 weight % lanthanum, further preferably 0.2 to 0.3 weight % lanthanum;
- the coating comprises from 0 to 5% by weight of magnesium;
- the coating comprises from 0.5 to 10% by weight of silicon, preferably 0.5 to 5% by weight of silicon;
- the thickness of the coating is 10 to 50 μm, preferably 27 to 50 μm,
- the coating is obtained by hot dipping.

Coatings having a weight content of:

- 2% silicon, 10% zinc, 0.2% lanthanum, and up to 0.3% by weight in accumulated weight of additional elements, the remainder being formed of aluminum and residual elements or unavoidable impurities, or
- 2% silicon, 4% zinc, 2% magnesium, 0.2% lanthanum, and up to 0.3% by weight, in accumulated weight, of additional elements, the remainder being formed of aluminum and residual elements or inevitable impurities, are particularly preferred.

In the meaning of the present application, the expression "between X and Y %" (e.g. between 1 and 40% by weight of zinc) implies that the values X et Y are excluded, whereas the expression "from X to Y %" (e.g. from 1 to 40% by weight of zinc) implies that the values X and Y are included.

The sheet coating of the invention may particularly comprise from 1 to 34% by weight of zinc, 0.05 to 0.4% by weight of lanthanum, 0 to 5% by weight of magnesium, 0.3 to 10% by weight of silicon and up to 0.3% by weight in accumulated weight of additional elements, the remainder being formed of aluminum and residual elements or unavoidable impurities.

In general, the steel of the sheet in weight percentage comprises 0.15%<C<0.5%, 0.5%<Mn<3%, 0.1%<silicon<0.5%, Cr<1%, Ni<0.1%, Cu<0.1%, Ti<0.2%, Al<0.1%, P<0.1%, S<0.05%, 0.0005%<B<0.08%, the remainder being formed of iron and unavoidable impurities due to steel processing.

A further subject of the invention is a method to manufacture a steel part provided with a coating providing sacrificial cathodic protection comprising the following steps taken in this order and consisting of:

Providing a previously coated steel sheet such as defined above, then cutting the sheet to obtain a blank, then heating the blank in a non-protective atmosphere up to an austenitization temperature Tm of 840 to 950° C., then holding the blank at this temperature Tm for a time tm of 1 to 8 minutes, then hot drawing the blank to obtain a part that is cooled at a rate such that the microstructure of the steel comprises at least one constituent selected from among martensite and bainite to obtain a steel part provided with a coating providing sacrificial cathodic protection, the temperature Tm, time tm, thickness of the prior coating and contents of lanthanum, zinc and optionally magnesium being selected such that the final mean content of iron in an upper portion of the coating of said steel part provided with a coating providing sacrificial cathodic protection is less than 75% by weight.

A further subject of the invention is a part provided with a coating providing sacrificial cathodic protection obtainable using the process of the invention or by cold drawing a sheet of the invention, and that is more particularly intended for the automobile industry.

BRIEF DESCRIPTION OF THE DRAWING

The FIGURE illustrates extension of red rust as a function of time in hours for each of the 6 tested coatings.

DETAILED DESCRIPTION

The invention is now described in detail with reference to particular embodiments given as non-limiting examples.

The invention is directed towards steel sheet provided with a coating comprising lanthanum in particular. Without wishing to be bound by any theory, it would seem that lanthanum acts as protective element for the coating.

The coating comprises from 0.01 to 0.4 weight % lanthanum, in particular 0.05 to 0.4 weight % lanthanum, typically 0.1 to 0.3 weight % lanthanum, preferably 0.2 to 0.3 weight % lanthanum. When the lanthanum content is lower than 0.01%, the effect of increased corrosion resistance is not observed. The same applies when the lanthanum content exceeds 0.4%. Proportions of 0.1 to 0.3 weight % lanthanum are particularly suitable to minimize the onset of red rust and hence to protect against corrosion.

The coating of the sheet of the invention comprises 5 to 40 weight % zinc and optionally up to 10 weight % magnesium. Without wishing to be bound by any theory, it would appear that these elements, in association with lanthanum, allow a reduction in the electrochemical potential of the coating in relation to the steel, in media containing or not containing chloride ions. The coatings of the invention therefore have sacrificial cathodic protection.

It is preferred to use zinc that has a greater protection effect than magnesium and is easier to use since less oxidizable. Therefore, it is preferred to use between 1 and 40% by weight of zinc, in particular from 1 to 34 weight % zinc, preferably 2 to 20 weight % zinc, whether or not associated with 1 to 10%, even 1 to 5% by weight magnesium.

The coatings of the sheets of the invention also comprise up to 15 weight % silicon, in particular from 0.1 to 15%, typically 0.5 to 10 weight % silicon, preferably 0.5 to 5 weight % silicon e.g. 1 to 3% silicon. Silicon in particular allows the imparting of high oxidation resistance to the sheets at high temperature. The presence of silicon therefore allows use thereof up to 650° C. without any risk of flaking of the coating. In addition, silicon can prevent the formation of a thick iron-zinc intermetallic layer when coating via hot dip, an intermetallic layer that would reduce the adhesion and workability of the coating. With the presence of a silicon content higher than 0.5 weight %, the coatings particularly lend themselves to press hardening and in particular to forming via hot drawing. For this purpose, it is therefore preferred to use an amount of 0.5 to 15% silicon. A content higher than 15 weight % is not desirable since in this case primary silicon would be formed which could degrade the properties of the coating, in particular properties of corrosion resistance.

The coatings of the sheets of the invention may also comprise, in accumulated content, up to 0.3 weight %, preferably up to 0.1 weight %, even less than 0.05 weight % of additional elements such as Sb, Pb, Ti, Ca, Mn, Cr, Ni, Zr, In, Sn, Hf or Bi. These different elements inter alia may allow improved corrosion resistance of the coating, or improved strength or adhesion for example. Persons skilled in the art having knowledge of their effects on the characteristics of the coating will know how to use these in relation to the desired additional objective, in the proportion adapted thereto which is generally from 20 ppm to 50 ppm. It was additionally verified that these elements do not interfere with the main properties sought by the invention.

The coatings of the sheets of the invention may also comprise residual elements and unavoidable impurities originating in particular from pollution of the hot dip galvanizing baths through the passing of steel strips, or from impurities derived from the ingots feeding these same baths or ingots used to feed vacuum deposit processes. As residual element, mention may particularly be made of iron which may be contained in amounts of up to 5 weight % and in general from 2 to 4 weight % in hot dip coating baths. The coating may therefore comprise from 0 to 5 weight % iron e.g. from 2 to 4 weight %.

Finally, the coatings of the sheets of the invention comprise aluminum the content of which may range from about 29% to nearly 99% by weight. This element allows protection against sheet corrosion to be ensured via a barrier effect. It increases the melting point and evaporation point of the coating, thereby providing for easier forming in particular by hot drawing over an extended range of time and temperature. This may be of particular interest when the composition of the sheet steel and/or intended final microstructure of the part require an austenitization phase at high temperature and/or for long periods of time. In general, the coating comprises more than 50%, in particular more than 70%, preferably more than 80 weight % aluminum.

The coatings of the sheet of the invention do not comprise an amorphous phase. The presence or absence of an amorphous phase can be verified in particular by differential scanning calorimetry (DSC). The amorphous phase is generally difficult to form. It is usually formed via a considerable increase in cooling rate. Document EP 1 997 927 describes the obtaining of an amorphous phase by acting on cooling rate, said rate being dependent on the cooling method and thickness of the coating.

Preferably the microstructure of the coating comprises:

an interface layer comprising two layers:

(i) a very thin layer of $FeAl_3/Fe_2Al_5$, and (ii) a FeSiAl intermetallic layer, e.g. of 5 μm thickness, an upper layer formed of a solid Al—Zn solution and Si-rich needles.

Lanthanum is also contained in the microstructure of the coating.

When the zinc content is higher than 20%, the upper layer may also contain Al—Zn binary.

The thickness of the coating is preferably from 10 to 50 μm. Below 10 μm, there is a risk that protection against corrosion of the strip will be insufficient. Above 50 μm, protection against corrosion exceeds the desired level, in particular in the automobile industry. In addition, should a coating of such thickness be subjected to a high temperature rise and/or over long periods of time, there is a risk that the upper portion will melt and flow onto the furnace rolls or into the drawing tools, deteriorating the latter. A thickness of 27 to 50 μm is particularly adapted for the manufacture of press hardened parts in particular by hot drawing.

Regarding the steel employed for the sheet of the invention, the type of steel is not critical for as long as the coating is able to adhere sufficiently thereto.

However, for some applications requiring high mechanical strength, such as structural automobile parts, it is preferred that the steel should have a composition allowing the part to reach a tensile strength of 500 to 1600 MPa as a function of conditions of use.

Over this range of resistances, it is particularly preferred to use a steel composition comprising in weight %: $0.15\%<C<0.5\%$, $0.5\%<Mn<3\%$, $0.1\%<Si<0.5\%$, $Cr<1\%$, $Ni<0.1\%$, $Cu<0.1\%$, $Ti<0.2\%$, $Al<0.1\%$, $P<0.1\%$, $S<0.05\%$, $0.0005\%<B<0.08\%$, the remainder being iron and unavoidable impurities derived from steel processing. One example of a commercially available steel is 22MnB5.

If the desired level of resistance is in the order of 500 MPa, it is preferred to use a steel composition comprising: $0.040\%\leq C\leq 0.100\%$, $0.80\%\leq Mn\leq 2.00\%$, $Si\leq 0.30\%$, $S\leq 0.005\%$, $P\leq 0.030\%$, $0.010\%\leq Al\leq 0.070\%$, $0.015\%\leq Nb\leq 0.100\%$, $0.030\%\leq Ti\leq 0.080\%$, $N\leq 0.009\%$, $Cu\leq 0.100\%$, $Ni\leq 0.100\%$, $Cr\leq 0.100\%$, $Mo\leq 0.100\%$, $Ca\leq 0.006\%$, the remainder being iron and unavoidable impurities derived from steel processing.

The steel sheets can be manufactured by hot rolling and may optionally be cold re-rolled depending on the intended final thickness, which may vary from 0.7 to 3 mm for example.

The sheets can be coated using any adapted means such as an electroplating process or vacuum deposit process, or under pressure close to atmospheric pressure such as deposit by magnetron sputtering, by cold plasma or vacuum evaporation for example but the preferred process is hot dip coating in a molten metal bath. It is effectively observed that surface cathodic protection is higher with coatings obtained by hot dip than for coatings obtained with other coating processes.

If the hot dip coating process is used, after depositing of the coating, said coating is cooled until complete solidification at a cooling rate advantageously between 5 and 30° C./s, preferably between 15 and 25° C./s, for example by blowing an inert gas or air. The cooling rate of the present invention does not allow an amorphous phase to be obtained in the coating. The sheets of the invention can then be formed using any method adapted to the structure and shape of the parts to be manufactured e.g. by cold drawing.

However, the sheets of the invention are particularly adapted to the manufacture of press hardened parts, in particular by hot drawing.

For this process a previously coated steel sheet of the invention is provided and cut to obtain a blank. This blank is heated in a furnace in a non-protective atmosphere up to an austenitization temperature Tm of 840 to 950° C., preferably from 880 to 930° C., and the blank is held at this temperature Tm for a time tm of 1 to 8 minutes, preferably of 4 to 6 minutes.

The temperature Tm and hold time tm are dependent on the type of steel but also on the thickness of the sheet to be drawn which must be fully within the austenite region before forming. The higher the temperature Tm the shorter the hold time tm, and vice-versa. In addition, the rate of temperature rise also has an impact on these parameters, a fast rate (higher than 30° C./s for example) also allowing a reduction in the hold time tm.

The blank is subsequently transferred to a hot drawing tool and drawn. The part obtained is cooled either in the drawing tool itself or after transfer towards a specific cooling equipment.

In all cases, the cooling rate is controlled as a function of the composition of the steel so that the final microstructure after hot drawing comprises at least one constituent from among martensite and bainite, to reach the desired level of mechanical strength.

By controlling the temperature Tm, time tm, the thickness of the prior coating and/or its content of lanthanum, zinc and optionally magnesium so that the final mean iron content of the upper portion of the coating of the part is less than 75 weight %, preferably less than 50 weight %, even less than 30 weight %, this generally allows the coated, hot-drawn part to have sacrificial cathodic protection. This upper portion has a thickness of at least 5 μm and is generally less than 13 μm. The iron proportion can be measured by glow discharge spectrometry for example (GDS).

Under the effect of heating up to austenitization temperature Tm, the iron derived from the substrate diffuses in the prior coating and increases the electrochemical potential thereof. To maintain satisfactory cathodic protection, it is therefore necessary to limit the mean iron content in the upper portion of the final coating of the part.

To do so, it is possible to limit the temperature Tm and/or hold time tm. It is also possible to increase the thickness of the prior coating to prevent the iron diffusion front from reaching as far as the surface of the coating. In this respect, it is preferred to use sheet having a prior coating thickness of 27 μm or more, preferably 30 μm or more, even 35 μm or more.

To limit loss of the cathodic property of the coating, it is also possible to increase the contents of lanthanum and/or zinc and optionally of magnesium in the prior coating.

At all events, it is within the reach of skilled persons to act on these different parameters, also taking into account the type of steel, to obtain a coated, press hardened steel part, in particular one that is hot drawn having the qualities required by the invention.

The following examples and Figures illustrate the invention.

The FIGURE illustrates extension of red rust as a function of time in hours for each of the 6 tested coatings.

Implementation tests were conducted to illustrate some embodiments of the invention.

Tests

Tests were conducted with 4 triple-layer specimens each formed of 22MnB5 sheet, cold rolled to a thickness of 5 mm ($1^{st}$ layer), provided with a coating obtained by hot dip of thickness 1 mm and having the composition specified below ($2^{nd}$ layer), itself coated with a second 22MnB5 sheet, cold rolled to a thickness of 5 mm ($3^{rd}$ layer).

The 6 tested coatings had the following content in weight %:

2% silicon, 10% zinc, the remainder being formed of aluminum and residual elements or unavoidable impurities, 2% silicon, 10% zinc, 0.2% lanthanum, the remainder being formed of aluminum and residual elements or unavoidable impurities, 2% silicon, 10% zinc, 0.5% lanthanum, the remainder being formed of aluminum and residual elements or unavoidable impurities, 2% silicon, 4% zinc, 2% magnesium, the remainder being formed of aluminum and residual elements or unavoidable impurities, 2% silicon, 4% zinc, 2% magnesium, 0.2% lanthanum, the remainder being formed of aluminum and residual elements or unavoidable impurities, 2% silicon, 4% zinc, 2% magnesium, 0.5% lanthanum, the remainder being formed of aluminum and residual elements or unavoidable impurities.

Different corrosion tests were performed on this batch of specimens:

an accelerated corrosion test, allowing simulation of atmospheric corrosion (cyclical corrosion test VDA 233-102);

static tests in a climate chamber at 35° C. or 50° C. and 90% or 95% relative humidity (RH). The specimens were sprayed with 1% NaCl solution (pH 7) once a day over a total period of 15 days.

For each of these tests, red rust extension and electrochemical measurements were carried out and are given in the Tables below.

| | Al—2Si—10Zn | Al—2Si—10Zn—0.2La | Al—2Si—10Zn—0.5La | Al—2Si—4Zn—2Mg | Al—2Si—4Zn—2Mg—0.2La | Al—2Si—4Zn—2Mg—0.5La |
|---|---|---|---|---|---|---|
| N-VDA test, red rust | No protection | Partial protection | No protection | No protection | Partial protection | No protection |
| Mean surface on which red rust extended in static test (%) | 25 | 5 | 38 | 28 | 6 | 24 |
| N-VDA, 35° C./95% RH, mean galvanic current (nA) | | | | −700 | 1862 | 240 |
| N-VDA, 50° C./90% RH, mean galvanic current (nA) | | | | −120 | 1400 | 250 |

The FIGURE shows that the extension of red rust is lower:

with a coating of 2% silicon, 10% zinc, 0.2% lanthanum, the remainder being formed of aluminum and residual elements or unavoidable impurities, compared with:

a coating of 2% silicon, 10% zinc, 0.5% lanthanum, the remainder being formed of aluminum and residual elements or unavoidable impurities, or a coating of 2% silicon, 10% zinc, the remainder being formed of aluminum and residual elements or unavoidable impurities, with a coating of 2% silicon, 4% zinc, 2% magnesium, 0.2% lanthanum, the remainder being formed of aluminum and residual elements or unavoidable impurities, compared with:

a coating of 2% silicon, 4% zinc, 2% magnesium, 0.5% lanthanum, the remainder being formed of aluminum and residual elements or unavoidable impurities, or a coating of 2% silicon, 4% zinc, 2% magnesium, the remainder being formed of aluminum and residual elements or unavoidable impurities.

The FIGURE also shows that the coating with 0.2% lanthanum has a galvanic coupling current with steel that is much higher than the coating without lanthanum or with 0.5% lanthanum. These results indicate that the coating with 0.2% lanthanum is active and sacrificial, and therefore provides the steel with better cathodic protection.

What is claimed is:

1. A process to manufacture a part in steel provided with a coating providing sacrificial cathodic protection comprising the steps of:

providing a steel sheet previously coated with a coating providing sacrificial cathodic protection, the coating consisting of:

more than 80 weight % aluminium, from 1 to less than 19.99 weight % zinc, from 0.01 to 0.4 weight % lanthanum, up to 10 weight % magnesium, up to 15 weight % silicon, up to 5 weight % iron, up to 0.3 weight %, in accumulated weight, of additional elements selected from among Sb, Pb, Ca, Mn, Cr, Ni, Zr, Hf and Bi, and a remainder of the coating consisting of unavoidable impurities;

cutting the sheet to obtain a blank;

heating the blank in a non-protective atmosphere up to an austenitization temperature Tm of 840 to 950° C.;

holding the blank at the austenization temperature Tm for a time tm of 1 to 8 minutes;

hot drawing the blank to obtain a part that is cooled at a rate such that a microstructure of the steel comprises at least one constituent selected from among martensite and bainite to obtain a steel part provided with a coating providing sacrificial cathodic protection;

the temperature Tm, time tm, thickness of the prior coating and the lanthanum, zinc and optionally magnesium contents thereof being selected so that a final mean iron content in an upper portion of the coating of the steel part provided with a coating providing sacrificial cathodic protection is lower than 75 weight %.

2. A steel part provided with a coating providing sacrificial cathodic protection obtainable using the hot drawing process according to claim 1.

3. A steel sheet provided with a coating providing sacrificial cathodic protection, the coating consisting of:

more than 80 weight % aluminium, from 1 to less than 19.99 weight % zinc;

from 0.01 to 0.4 weight % lanthanum;

up to 10 weight % magnesium;

up to 15 weight % silicon;

up to 5 weight % iron;

up to 0.3 weight %, in accumulated weight, of additional elements selected from among Sb, Pb, Ca, Mn, Cr, Ni, Zr, Hf and Bi; and a remainder of the coating consisting of unavoidable impurities.

4. The steel sheet provided with a coating providing sacrificial cathodic protection according to claim 3, wherein the unavoidable impurities are derived from pollution of hot dip galvanizing baths through a passing of steel strips or impurities derived from ingots feeding the galvanizing baths or from ingots feeding vacuum deposit processes.

5. The steel sheet provided with a coating providing sacrificial cathodic protection according to claim 3, wherein the coating comprises 2 to 20 weight % of zinc.

6. The steel sheet provided with a coating providing sacrificial cathodic protection according to claim 3, wherein the coating comprises 0.1 to 0.3 weight % of lanthanum.

7. The steel sheet provided with a coating providing sacrificial cathodic protection according to claim 3, wherein the coating comprises 0.2 to 0.3 weight % of lanthanum.

8. The steel sheet provided with a coating providing sacrificial cathodic protection according to claim 3, wherein the coating comprises from 0 to 5 weight % of magnesium.

9. The steel sheet provided with a coating providing sacrificial cathodic protection according to claim 3, wherein the coating comprises from 0.5 to 10 weight % of silicon.

10. The steel sheet provided with a coating providing sacrificial cathodic protection according to claim 3, wherein the steel includes a weight content of $0.15\%<C<0.5\%$, $0.5\%<Mn<3\%$, $0.1\%<Si<0.5\%$, $Cr<1\%$, $Ni<0.1\%$, $Cu<0.1\%$, $Al<0.1\%$, $P<0.1\%$, $S<0.05\%$, $0.0005\%<B<0.08\%$, the remainder being formed of iron and unavoidable impurities due to steel processing.

11. The steel sheet provided with a coating providing sacrificial cathodic protection according to claim 3, wherein the coating has a thickness of 10 to 50 μm.

12. The steel sheet provided with a coating providing sacrificial cathodic protection according to claim 11, wherein the said coating has a thickness of 27 to 50 μm.

13. The steel sheet provided with a coating providing sacrificial cathodic protection according to claim 3, wherein the coating is applied to the steel sheet by hot dip.

14. A steel part provided with a coating providing sacrificial cathodic protection obtainable by cold drawing a sheet according to claim 3.

15. A steel sheet provided with a coating providing sacrificial cathodic protection, the coating comprising:

more than 80 weight % aluminium, from 1 to less than 19.99 weight % zinc;

from 0.01 to 0.4 weight % lanthanum;

up to 10 weight % magnesium;

up to 15 weight % silicon;

up to 5 weight % iron;

up to 0.3 weight %, in accumulated weight, of additional elements selected from among Sb, Pb, Ca, Mn, Cr, Ni, Zr, Hf and Bi;

and unavoidable impurities;

wherein the coating providing sacrificial cathodic protection is free from Ti.

16. A steel sheet provided with a coating providing sacrificial cathodic protection, the coating consisting of:

from 1 to less than 19.99 weight % zinc;

from 0.01 to 0.4 weight % lanthanum;

up to 15 weight % silicon;

up to 5 weight % iron;

up to 0.3 weight %, in accumulated weight, of additional elements selected from among Sb, Pb, Ca, Mn, Cr, Ni, Zr, Hf and Bi; and a remainder of the coating consisting of aluminium and unavoidable impurities.

* * * * *